US005559310A

United States Patent [19]

Hoover et al.

[11] Patent Number: 5,559,310

[45] Date of Patent: Sep. 24, 1996

[54] MUFFLER FOR AIR OPERATED RECIPROCATING PUMPS

[75] Inventors: Rick D. Hoover; Nicholas Kozumplik, Jr., both of Bryan, Ohio; Joseph W. Sullivan, Lafayette, Ind.

[73] Assignee: Ingersoll-Rand Company, Woodcliff Lake, N.J.

[21] Appl. No.: 492,868

[22] Filed: Apr. 26, 1995

[51] Int. Cl.[6] ..... F01N 3/02

[52] U.S. Cl. ..... 181/230; 181/265; 181/272

[58] Field of Search ..... 181/230, 229, 181/224, 240, 243, 265, 266, 272, 273, 282

[56] References Cited

U.S. PATENT DOCUMENTS

| | | | |
|---|---|---|---|
| 3,590,947 | 7/1971 | Latch | 181/265 |
| 4,033,428 | 7/1977 | Wennerstrom | 181/230 |
| 4,105,090 | 8/1978 | Tachibana et al. | 181/265 |
| 4,401,418 | 8/1983 | Fritchman | 181/403 X |
| 4,858,722 | 8/1989 | Abbe et al. | 181/243 |
| 5,373,119 | 12/1994 | Suzuki et al. | 181/230 |

*Primary Examiner*—Khanh Dang
*Attorney, Agent, or Firm*—Walter C. Vliet

[57] ABSTRACT

An open path low back pressure muffler for reciprocating air motor pulsing exhaust providing an increased area inlet orifice, double flow path reversal with directional flow assistance and a turnable sound absorbing lined duct exit.

5 Claims, 1 Drawing Sheet

MUFFLER FOR AIR OPERATED RECIPROCATING PUMPS

BACKGROUND OF THE INVENTION

This invention relates generally to mufflers and more particularly to mufflers for reciprocating pumps and the like which produce an exhaust blast from a reciprocating air motor.

Current devices used to quiet the exhaust blast from air operated reciprocating motors consist of modified automotive designs, for example a metallic or plastic canister with a wire mesh, screen or mat to reduce noise levels. Cost is relatively low.

The air exhausting from a reciprocating air motor can typically range from 10–125 PSIG and flow rates in excess of 200 SCFM. Noise levels can be in excess of 105 dbA due to rapid air expansion. The rapid expansion of air also results in very low exhaust temperatures (−100° F.). Any moisture in the exhaust air can result in ice formation in the muffler.

The above mentioned mufflers tend to be restrictive which impacts negatively on motor performance. In order for the motor to perform efficiently it must be able to exhaust rapidly. This affects time for the motor to reverse direction and power required to push residual exhaust air out of the motor. Ice that forms in the muffler results in increased back pressure and degradation of motor performance. The restrictive nature of the muffler also cause the air velocity through the muffler to increase which generates additional noise.

The foregoing illustrates limitations known to exist in present devices and methods. Thus it is apparent that it would be advantageous to provide an alternative directed to overcoming one or more of the limitations set forth above. Accordingly a suitable alternative is provided including features more fully disclosed hereinafter.

SUMMARY OF THE INVENTION

In one aspect of the present invention this is accomplished by providing a muffler for air operated reciprocating motors including a molded chamber having an inlet, a first air turn chamber, a concentric flow path formed within the molded chamber, a second air turn chamber, and a sound absorbing lined duct inserted within the lined chamber and forming part of the concentric flow path, the lined duct further extending substantially the length of the chamber inwardly and terminating in an exhaust outlet externally at a surface of the chamber.

The foregoing and other aspects of the invention will become apparent from the following detailed description of the invention when considered in conjunction with the accompanying drawing figures.

BRIEF DESCRIPTION OF THE DRAWING FIGURES

FIG. 1 is a cross sectional view illustrating an embodiment of the present invention.

DETAILED DESCRIPTION

Figure 1:
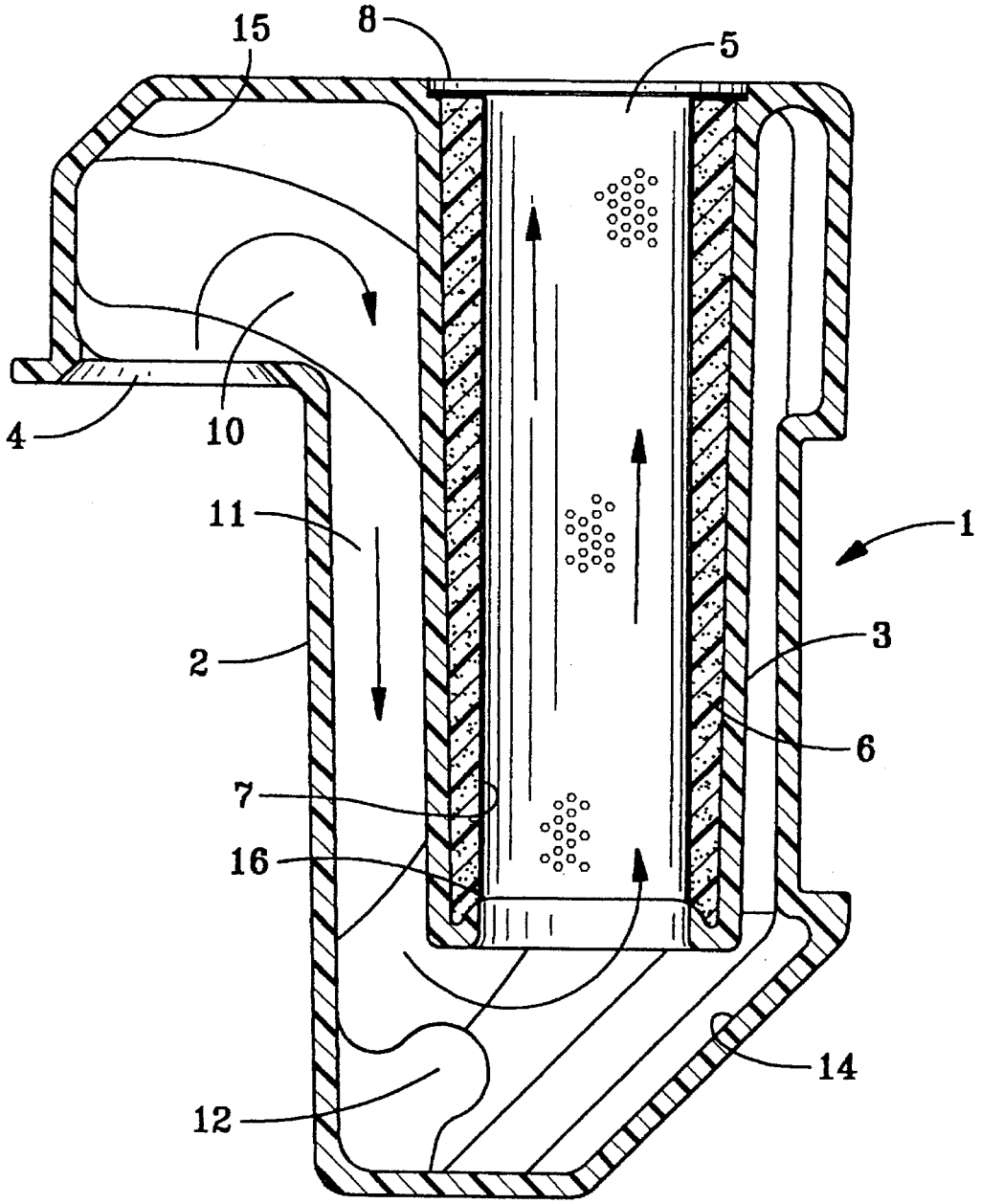

The invention provides low restriction, is non-icing and provides lower decibel levels than conventional mufflers.

The device consists of an accumulator chamber and a lined duct. The accumulator chamber is a rotationally molded polyethylene which provides sufficient mass to limit noise transmission through the walls. The duct is molded as an integral part of the chamber. Sound absorbing foam with a perforated liner is inserted into the duct and retained externally.

The chamber is of sufficient volume to allow expansion of the exhaust air to reduce air velocity and eliminate exhaust restriction. Exhaust air enters the lined duct through an orifice which is approximately 16 times the area of the motor exhaust porting. This results in a very low restriction muffler which is virtually immune to icing.

Noise is attenuated as it passes through the duct. Attenuation frequency is tuned by changing the open area of the perforated foam liner and the type of foam absorption material.

In particular, referring to FIG. 1, a muffler for a reciprocating air motor, particularly an air operated diaphragm pump motor, is shown and generally designated by the reference numeral 1. A molded muffle chamber 2, which may be manufactured of polyethylene or the like of sufficient thickness to provide a mass sufficient to limit noise transmission through the walls, forms both the interior and exterior confines of the muffler body. A lined duct 3 is molded integral in the interior of the chamber 2. An inlet 4 at the near end of the molded muffle chamber receives the exhaust blast from the reciprocating motor and the muffled air exits the muffler at outlet port 5.

The design of the muffler provides for a first air turn anterior chamber 10 near the inlet including a deflecting surface 15 for assisting the air turn, a peripheral passageway 11, a second interior air turn chamber 12 located at the distal end of the molded muffle chamber including a deflector 14 for assisting air into the inlet of the lined duct 3. A foam liner 6 lines the duct and may be protected by a perforated metal shield 7 or the like. The perforated acoustical absorption foam liner is inserted into the lined duct and retained therein by means of a retainer 8. The interior end of the foam liner cooperates with a formed lip seal 16 to limit bypass and to prevent movement of the liner within the duct.

As previously stated the attenuation frequency of the muffler is tuned by changing the open area of the perforated metal shield and the type of foam acoustical absorption material.

Having described our invention in terms of a preferred embodiment we do not wish to be limited in the scope of our invention except as claimed.

What is claimed is:

1. A muffler for exhausting air from a reciprocating air motor comprising:

a molded muffle chamber having an inlet for receiving exhaust air flowing in a first inlet direction, a first exhaust air turn chamber located anterior to said muffle chamber between said inlet and one near end of said muffle chamber for changing said exhaust air flow to a second muffle chamber exhaust air flow direction, a concentric flow path for said exhaust air formed within and along a length of said molded muffle chamber, a second exhaust air turn chamber located interior of and at a distal end of said molded muffle chamber, and a sound absorbing lined duct inserted within said molded muffle chamber and forming part of said concentric flow path, said sound absorbing lined duct further extending substantially the length of said molded muffle chamber from said second exhaust air turn chamber to and terminating in an exhaust outlet at a surface in said near end of said molded muffle chamber for conducting said exhaust air from said second exhaust air turn chamber to said exhaust outlet.

2. A muffler according to claim 1 wherein: air turn deflectors are provided between said inlet and said first air turn chamber and said second air turn chamber and said lined duct.

3. A muffler according to claim 1 wherein: said molded muffle chamber is formed of a sound retaining thick plastic molding.

4. A muffler according to claim 1 wherein: said sound absorbing lined duct is lined with a sound absorbing acoustical absorption foam covered by a perforated metal shield of selected opening size to tune the muffler for an application.

5. A muffler according to claim 4 wherein: said foam and said perforated metal shield are replaceable.

* * * * *